US005758459A

United States Patent [19]

Koike et al.

[11] Patent Number: 5,758,459

[45] Date of Patent: Jun. 2, 1998

[54] SASH FRAME STRUCTURE FOR ATTACHING GLASS

[75] Inventors: Sou Koike; Masao Hirano, both of Toyama-ken, Japan

[73] Assignee: YKK Architectural Products Inc., Tokyo, Japan

[21] Appl. No.: 741,107

[22] Filed: Oct. 30, 1996

[30] Foreign Application Priority Data

Oct. 31, 1995 [JP] Japan ..... 7-283072

[51] Int. Cl.[6] ..... E06B 5/00

[52] U.S. Cl. ..... 52/235; 52/204.5; 52/204.591; 52/204.69; 52/204.7; 52/773; 52/775; 52/800.14

[58] Field of Search ..... 52/235, 204.5, 52/204.53, 204.591, 204.593, 204.597, 204.6, 204.62, 204.69, 204.7, 202, 762, 764, 770, 772, 773, 775, 778, 780, 800.14

[56] References Cited

U.S. PATENT DOCUMENTS

| | | | |
|---|---|---|---|
| 3,147,518 | 9/1964 | Horgan, Jr. | 52/235 X |
| 3,196,992 | 7/1965 | Owen | 52/775 X |
| 3,250,663 | 5/1966 | Sharp et al. | 52/773 X |
| 3,352,078 | 11/1967 | Neal | 52/775 X |
| 3,638,385 | 2/1972 | Nobels et al. | 52/235 X |
| 3,720,025 | 3/1973 | Eichman | 52/235 X |
| 4,332,111 | 6/1982 | Terashima | 52/204.591 X |
| 4,537,002 | 8/1985 | Ellingson | 52/235 X |
| 4,543,283 | 9/1985 | Curtze et al. | 52/800.14 X |
| 4,628,655 | 12/1986 | Scheiderer | 52/204.591 |
| 4,841,700 | 6/1989 | Matthews . | |
| 4,879,957 | 11/1989 | Habicht et al. | 52/204.5 X |
| 4,934,115 | 6/1990 | Nozaki . | |
| 5,036,637 | 8/1991 | Biebuyck | 52/235 |
| 5,353,565 | 10/1994 | Tanikawa | 52/202 X |

FOREIGN PATENT DOCUMENTS

| | | | |
|---|---|---|---|
| 3203253 | 8/1983 | Germany | 52/204.5 |
| 3841680 | 11/1989 | Germany | 52/204.5 |
| 4303874 | 8/1994 | Germany | 52/204.5 |
| 2245298 | 1/1992 | United Kingdom | 52/204.5 |

OTHER PUBLICATIONS

"Geyser Grid System", E.K. Geyser Company, four page brochure Oct. 1967.

*Primary Examiner*—Wynn E. Wood
*Assistant Examiner*—Laura A. Callo
*Attorney, Agent, or Firm*—Finnegan, Henderson, Farabow, Garrett & Dunner, L.L.P.

[57] ABSTRACT

In a sash frame structure for attaching a glass in which a glass is supported in glass attachment channels formed to respective frame members constituting a sash frame by first side seal members and second side seal members disposed on the opposite sides of the glass, the glass is so provided as not to be scattered in pieces even if it is broken. A seal member fitting groove is formed to each of the frame members adjacently to the glass attachment channel, and an engaging portion is formed to the inner surface of the glass attachment channel on the side adjacent to the seal member fitting groove. One of the first side seal member and the second side seal member is a shaped seal gasket having a sealing portion and a fitting portion integrally formed with each other, and the sealing portion is adapted to be forced to be fitted in a space between the glass and the inner surface of the glass attachment channel and engaged on the engaging portion while the fitting portion is adapted to is fitted in the seal member fitting groove.

14 Claims, 6 Drawing Sheets

SASH FRAME STRUCTURE FOR ATTACHING GLASS

BACKGROUND OF THE INVENTION

The present invention relates to a sash frame structure for attaching a glass, particularly used for a storefront sash which is installed at the front of a building of a shop, a store or the like.

A conventional sash frame structure for attaching a glass is as follows.

An upper transverse frame member, a lower transverse frame member and bilateral vertical frame members are connected with each other to form a sash frame. The respective frame members are provided with a glass attachment channels, in which a glass is inserted and supported by a first side seal member and a second side seal member disposed on the opposite sides of the glass.

For the seal members, there are employed liquid applied sealant which is applied after the glass is inserted in the glass attachment channel and a shaped seal gasket which is made of synthetic rubber or the like and formed to a definite shape.

U.S. Pat No. 4,841,700 discloses an example of a shaped seal gasket. The shaped seal gasket has a fitting portion and a sealing portion, and is fitted by pushing the fitting portion into a seal member fitting groove of a frame member and pressing the sealing portion to be inserted between a glass and a glass attachment channel.

In the sash frame structure as mentioned above, it may happen that a certain object is blown off by a strong wind such as in typhoon and collides with and breaks the glass to pieces so that the broken pieces are scattered in the room. This is very dangerous.

In order to prevent such danger, it is conceivable that the glass is formed as a wired glass so that the broken pieces may not be separated and scattered in the room even if the glass is broken by collision of an object.

However, the wired glass may come off the sash frame when it is broken. In detail, when the wired glass is cracked or broken, the rigidity of the glass itself is reduced. Therefore, the wired glass is curved and deformed by a wind pressure of a strong wind, so that a force urging the wired glass to come off the glass attachment channel acts on the wired glass. This force pulls the wired glass together with the shaped seal gasket, so that the shaped seal gasket comes off a seal member fitting groove and does not function to support the glass any more. As a result, the wired glass comes off the sash frame so that the strong wind may directly blow into the room and scatter and damage the things in the room.

This is particularly the problem with a sash comprising a sash frame having a large frame opening such as a storefront sash. That is, in such sash, since the glass to be installed in the sash frame is accordingly large, the glass is easy to be curved and deformed by a wind pressure, therefore easy to come off the sash frame.

SUMMARY OF THE INVENTION

An object of the present invention is to substantially eliminate defects or drawbacks encountered in the prior art described above and to provide a sash frame structure for attaching a glass in which a shaped seal gasket is prevented from coming off a frame member and a glass is prevented from coming off a sash frame even if a glass is broken.

This and other objects of the present invention can be achieved by a sash frame structure for attaching a glass in which a glass is supported in glass attachment channels formed to respective frame members constituting a sash frame by first side seal members and second side seal members disposed on the opposite sides of the glass, wherein the glass is so provided as not to be scattered in pieces even if it is broken;

a seal member fitting groove is formed to each of the frame members adjacently to the glass attachment channel;

an engaging portion is formed to the inner surface of the glass attachment channel on the side adjacent to the seal member fitting groove; and one of the first side seal member and the second side seal member is a shaped seal gasket having a sealing portion and a fitting portion integrally formed with each other, the sealing portion being adapted to be forced to be fitted in a space between the glass and the inner surface of the glass attachment channel and engaged on the engaging portion while the fitting portion is adapted to be fitted in the seal member fitting groove.

In a preferred embodiment, the sealing portion of the shaped seal gasket comprises a body portion integrally formed with at least one main seal piece and at least one auxiliary seal piece respectively projecting toward the glass to be supported, the body portion is further provided with an integrally formed engaging piece adapted to be engaged on the engaging portion formed to the inner surface of the glass attachment channel, the projection length of the main seal piece is longer than that of the auxiliary seal piece, and the main seal piece is brought in pressure contact with the glass with the end portion of the main seal piece elastically bent on the glass when the shaped seal gasket is fitted in place.

In another preferred embodiment, a reinforcing member having low elasticity in the longitudinal direction and high flexibility is embedded in the shaped seal gasket continuously in the longitudinal direction thereof.

In the structure according to the present invention, when the glass is cracked or broken and then a wind pressure by a strong wind acts on the glass, the glass is curved and deformed so that a force urging the glass to come off the glass attachment channel acts on the glass. Owing to this force, the fitting portion of the shaped seal gasket is urged to come off the seal member attachment groove. However, since the shaped seal gasket is engaged on the engaging portion formed to the inner surface of the glass attachment channel, the shaped seal gasket is retained in place and continues to function to support the glass.

According to one of the preferred embodiments, when the glass is cracked or broken and then it is curved and deformed by a wind pressure, the auxiliary pieces of the shaped seal gasket comes in pressure contact with the glass and the main seal piece of the shaped seal gasket is elastically restored and maintain the pressure contact with the glass. Thus, the area of contact between the glass and the shaped seal gasket is increased and accordingly the friction resistance is increased, so that the glass is securely supported in the glass attachment channel and prevented from coming off the sash frame.

According to the other preferred embodiment, expansion and contraction of the shaped seal gasket in its longitudinal direction is prevented by the reinforcing core member embedded therein. Therefore, it is not necessary to take care that the shaped seal gasket is not stretched at the time of fitting thereof. Therefore, the fitting of the shaped seal gasket can be easily carried out.

The nature and further features of the present invention will be made clearer from the following description which is made with reference to the accompanying drawings.

DESCRIPTION OF THE PREFERRED EMBODIMENTS

Figure 1:
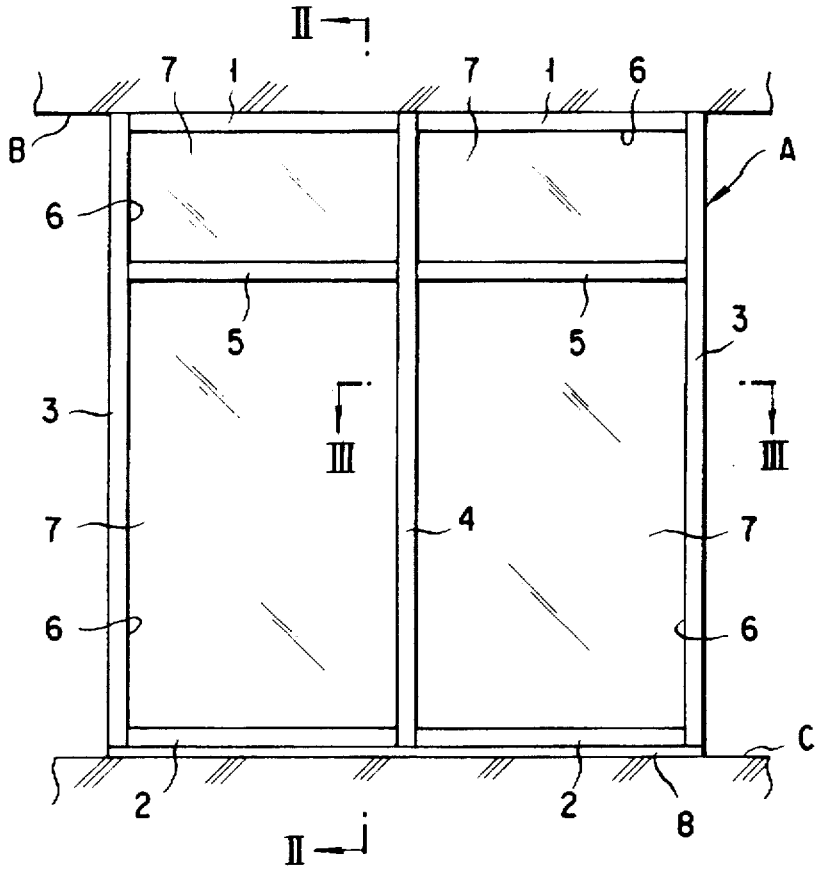
FIG. 1 is an illustrated front view showing an entire structure of a sash according to an embodiment of the present invention.

As shown in FIG. 1, an upper transverse frame member 1, a lower transverse frame member 2, bilateral, i.e., left and right vertical frame members 3, an intermediate vertical frame member 4 and an intermediate transverse frame member 5 are assembled to form a sash frame A. In detail, the upper transverse frame member 1, the intermediate transverse frame member and the lower transverse frame member 2 are extended between and connected with one of the vertical frame members 3 and the intermediate vertical frame member 4, and the upper transverse frame member 1, the intermediate transverse frame member 5 and the lower transverse frame member 2 are extended between and connected with the same intermediate vertical frame member 4 and the other vertical frame member 3, thereby constituting the sash frame A.

The sash frame A comprises opened frame sections 6 for attachment of glasses 7 at its bilateral upper and lower portions and is used to constitute a sash, for example, a storefront sash.

The above-mentioned sash is installed to an opening of a building. For example, the upper transverse frame member 1 is attached to the upper edge portion B of the opening, an attachment transverse member 8 is attached to the lower edge portion C of the opening, and the lower transverse frame member 2 is attached to the attachment transverse member 8.

The attachment transverse member 8 is an elongated member extending from one of the vertical frame members 3 to the other vertical frame member 3, and is provided to receive rain water penetrating, for example, through connecting portions between the lower transverse frame member 2 and each of the vertical frame members 3 and the intermediate vertical frame member 4 to thereby prevent the rain water from penetrating into the lower edge portion C of the opening.

Figure 2:
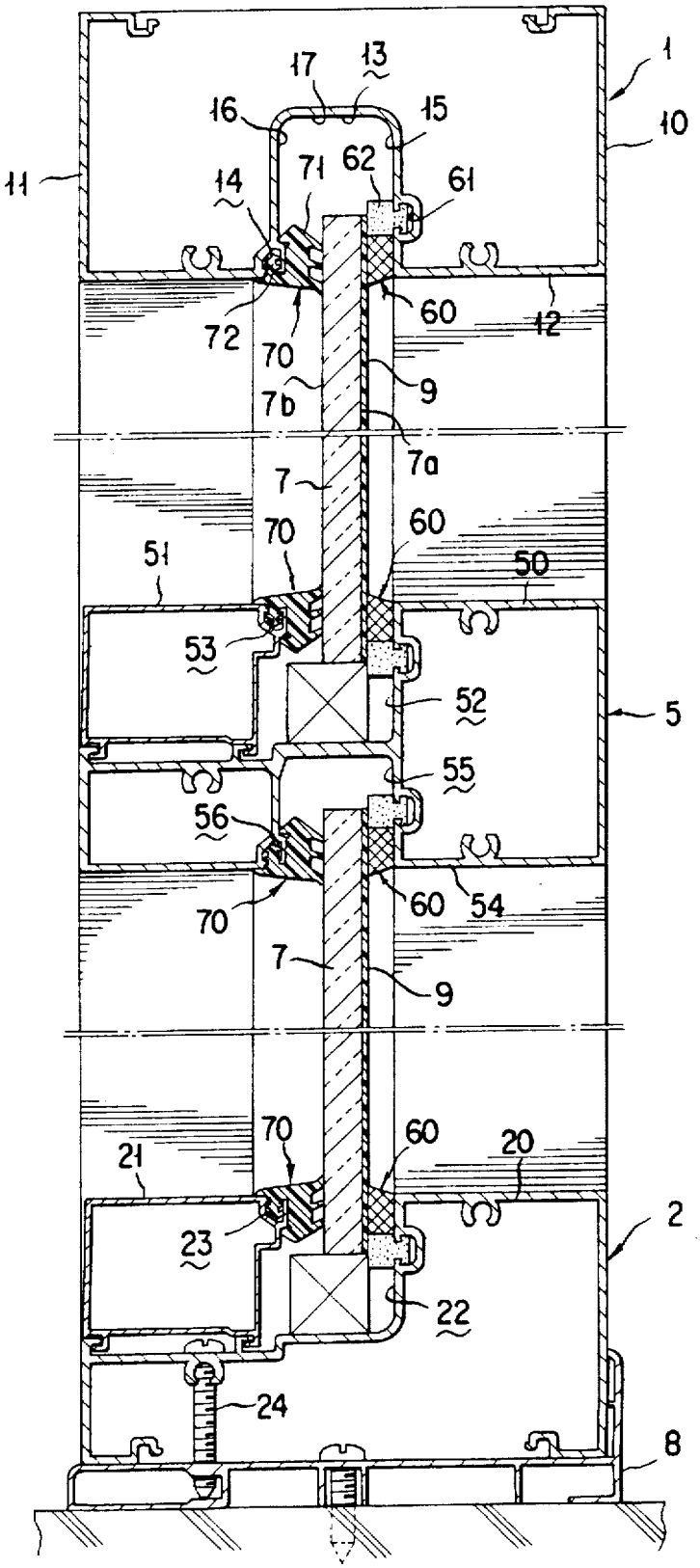
FIG. 2 is a sectional view taken along the line II—II in FIG. 1.

As shown in FIG. 2, a scattering preventing film 9 made of polyester film or the like is applied through heat fusing process to the first side (that is, indoor side in this embodiment) surface *7a* of the glass 7. By the scattering preventing film 9, the glass 7 is prevented from being separated and scattered in pieces even if a certain object is blown off by a strong wind and collides with and cracks or breaks the glass 7.

As shown in FIG. 2, the upper transverse frame member 1 is composed of a first side vertical plate member 10, a second side (that is, outdoor side in this embodiment) vertical plate member 11 and a connecting plate member 12 and has substantially an upward opening C-shape in section. The connecting plate member 12 is provided with an inward opening glass attachment channel 13 and an inward opening seal member fitting groove 14 adjacent to the glass attachment channel 13. (Here and hereinafter, the word "inward" shall mean the direction directed to the inside of the opened frame section 6.)

The lower transverse frame member 2 is formed by attaching a bead member 21 to a body frame member 20 so as to have an inward opening glass attachment channel 22. The bead member 21 is formed with an inward opening seal member fitting groove 23. The body frame member 20 is connected to the attachment transverse member 8 by means of screws 24.

Figure 3:
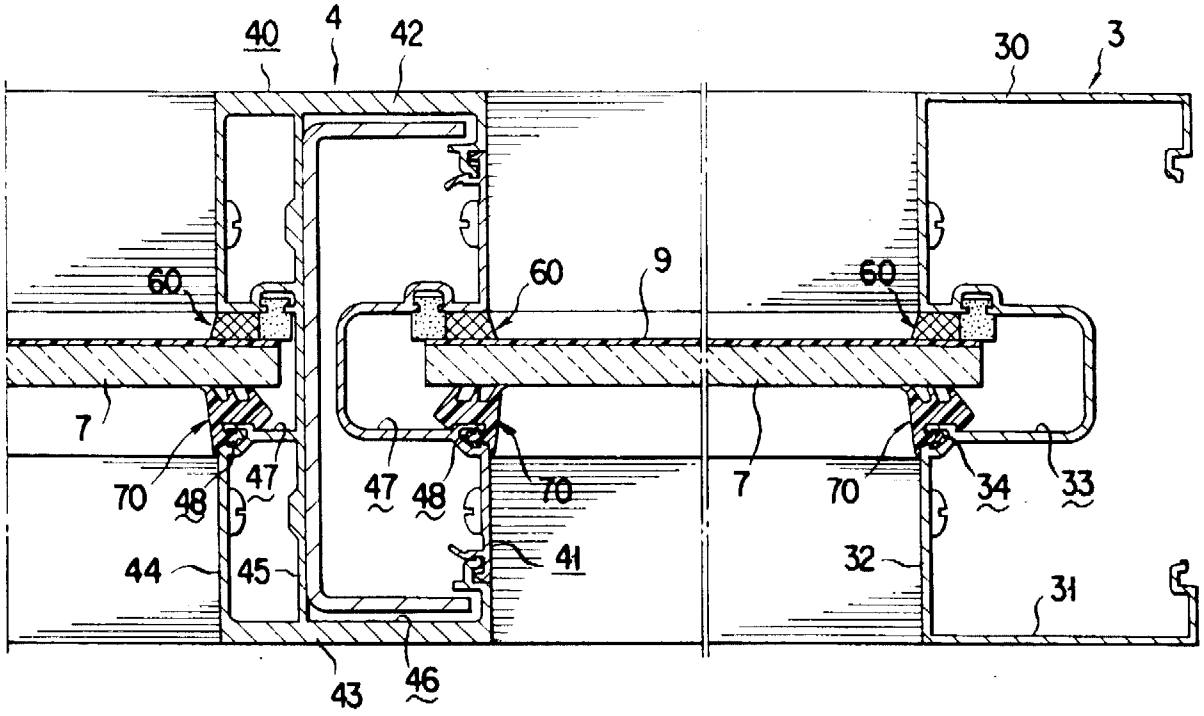
FIG. 3 is a sectional view taken along the line III—III in FIG. 1.

As shown in FIG. 3, the vertical frame member 3 is composed of a first side vertical plate member 30, an second side vertical plate member 31 and a connecting plate member 32 and has substantially an outward opening C-shape in section. (Here and hereinafter, the word "outward" shall mean the direction directed to the outside of the opened frame section 6.) The connecting plate member 32 is provided with an inward opening glass attachment channel 33 and a seal member fitting groove 34 adjacent to the glass attachment channel 33.

The intermediate vertical frame member 4 is formed by connecting an auxiliary frame member 41 to a body frame member 40. The body frame member 40 is composed of a first side vertical plate member 42, a second side vertical plate member 43, an end connecting plate member 44 and an intermediate connecting plate member 45, and has substantially a C-shape in section provided with an auxiliary frame member attachment recess 46. The end connecting plate member 44 and the auxiliary frame member 41 are respectively formed with an inward opening glass attachment channel 47 and a seal member fitting groove 48 adjacent to the glass attachment channel 47.

As shown in FIG. 2, the intermediate transverse frame member 5 is formed by attaching a bead member 51 to an body frame member 50 so as to have an inward opening glass attachment channel 52. The bead member 51 is formed with an upward opening seal member fitting groove 53. The lower transverse plate member 54 of the body frame member 50 is formed with an inward opening glass attachment channel 55 and an inward opening seal member fitting groove 56 adjacent to the glass attachment channel 55.

From the respective structures mentioned above, it follows that the glass attachment channels and the seal member fitting grooves are formed on the inner surface of each opened frame section 6 of the sash frame A continuously along the four peripheral sides of the opened frame section 6. The glass 7 is inserted in the glass attachment channels and supported by first side seal members 60 and second side seal members 70.

A structure for attaching the glass 7 to the upper transverse frame member 1 will be described hereunder.

As shown in FIG. 2, the glass attachment groove 13 of the upper transverse frame member 1 is composed of a first side inner surface 15 and a second side inner surface 16 opposite to each other and a bottom surface 17, and has substantially an inward opening C-shape in section. The first side and second side inner surfaces 15 and 16 are substantially parallel to the surface of the glass 7. A back-up member 62 is fitted to a recessed groove 61 formed to the first side inner surface 15, and a first side seal member 60 which is liquid applied sealant is applied to the space between the back-up member 62, the first side inner surface 15 and the first side surface 7a of the glass 7 on which the scattering preventing film 9 is applied in this embodiment.

The second side seal member 70 is a shaped seal gasket which is made of a rubber-like material such as synthetic rubber and is formed into a definite shape having a sealing portion 71 and a fitting portion 72. The fitting portion 72 is fitted into the seal member fitting groove 14 and the sealing portion 71 is pushed to be fitted into a space between the second side inner surface 16 of the glass attachment channel 13 and the second side surface **7*b* of the glass 7 so as to support the glass 7**.

Figure 4:
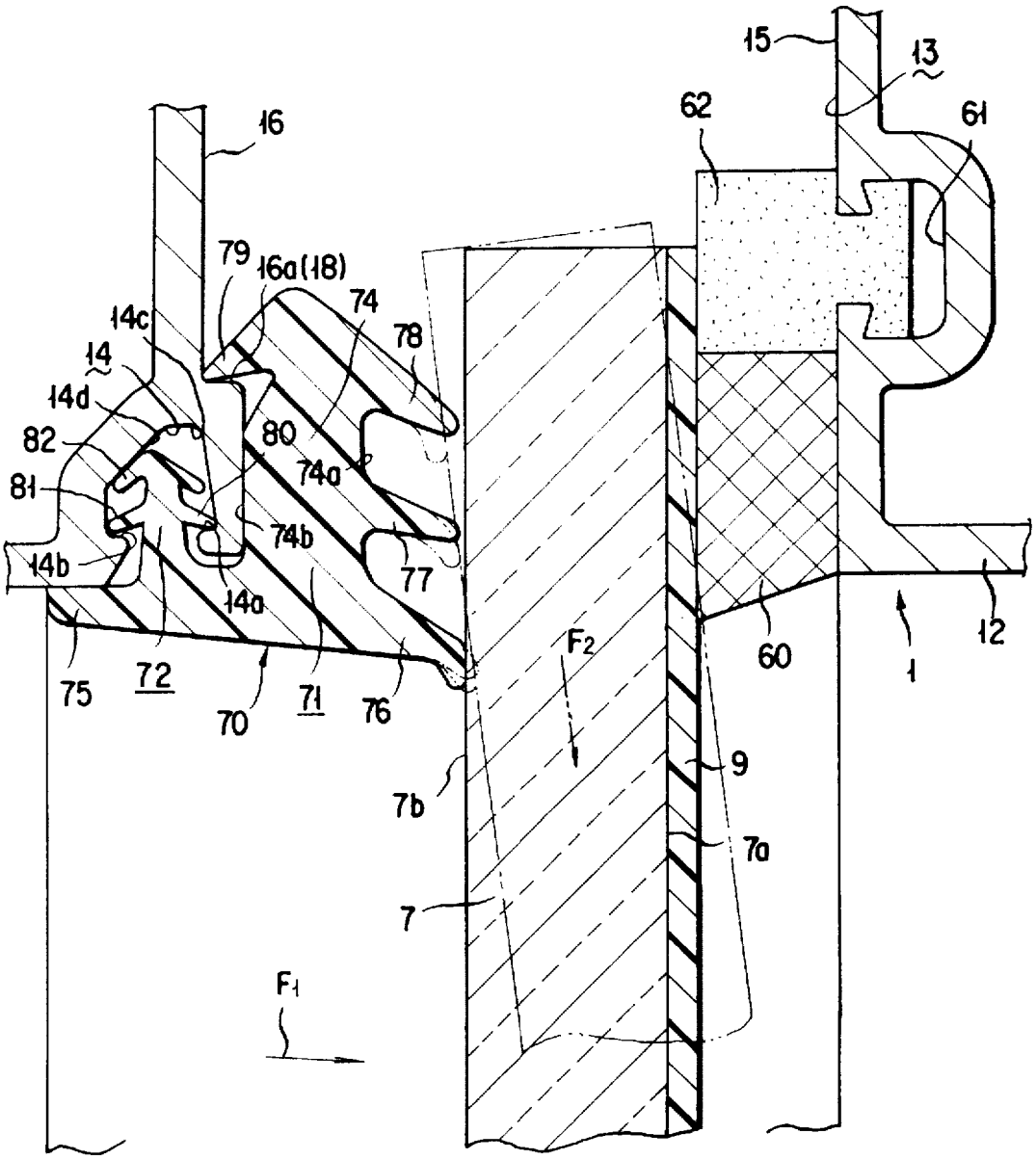
FIG. 4 is an enlarged sectional view of a glass attachment structure of an upper transverse frame member of the sash of FIG. 1.

As shown in FIG. 4, the second side inner surface 16 of the glass attachment channel 13 is bent substantially in a crank-shape in the vicinity of the opening end of the glass attachment channel 13 to provide a step portion **16*a* facing the bottom surface 17 of the glass attachment groove 13. The step portion 16*a* serves as an engaging portion 18** for preventing the seal member from coming off.

The seal member fitting groove 14 is provided with a first side engaging portion **14*a* and a second side engaging portion 14*b* at its first side and second side opening end portions. The second side oblique surface 14*d* adjacent to the bottom surface 14*c* is inclined relative to the second side inner surface 16**.

The sealing portion 71 of the seal member 70 is composed of a body portion 74 extending in a direction parallel to the surface of the glass 7 and a support portion 75 extending in a direction perpendicular to the surface of the glass 7 and has substantially a J-shape in section. The first side surface **74*a* of the body portion 74 which faces the glass surface and the second side surface 74*b* of the body portion 74 which faces the second side inner surface 16 of the glass attachment channel 13 are substantially parallel to the second side inner surface 16**.

The first side surface **74*a* of the body portion 74 is formed integrally with a main seal piece 76, a first auxiliary seal piece 77 and a second auxiliary seal piece 78 respectively projecting towards the surface 7*b* of the glass 7. The second side surface 74*b* of the body portion 74 is formed integrally with an engaging piece 79 on the side opposite to the supporting portion 75 (the upper side as viewed) so as to project towards the second side surface 16 of the glass attachment channel 13**.

The main and auxiliary seal pieces 76, 77 and 78 are positioned with a space from each other in a depth direction of the glass attachment channel 13. The main seal piece 76 is formed at a position nearest to the opening end of the glass attachment channel 13 and continuously connected to the support portion 75. The second auxiliary seal piece 78 is formed at a position nearest to the bottom surface 17 of the glass attachment channel 13 and continuously connected to the engaging piece 79. The first auxiliary seal piece 77 is positioned between the main seal piece 76 and the second auxiliary seal piece 78.

These main and auxiliary seal pieces 76, 77 and 78 obliquely project with different predetermined inclinations with respect to a plane perpendicular to the first side surface **74*a* of the body portion 74. The first auxiliary seal piece 77 has the smallest inclination, the second auxiliary seal piece 78 has the largest inclination and the main seal piece 76** has an intermediate inclination.

The main seal piece 76 has the longest projection length as shown with a dot and dash line in FIG. 4 and the first and second auxiliary seal pieces 77 and 78 have projection length shorter than that of the main seal piece 76. When the glass 7 is attached to the sash frame, the main seal piece 76 comes in pressure contact with the second side surface **7*b* of the glass 7 with its end portion elastically bent and deformed substantially in a hook-shape, while the first and second auxiliary seal pieces 77 and 78 are positioned separate from the second side surface 7*b* of the glass 7** with a slight space.

The main seal piece 76 has the largest thickness, the first auxiliary seal piece 77 has the smallest thickness and the second auxiliary seal piece 78 has an intermediate thickness.

The supporting portion 75 is provided to project beyond the fitting portion 72 to the second side and to abut against the connecting plate member 12.

The fitting portion 72 is provided with a first side engaging piece 80 to be engaged with the first side engaging portion **14*a* of the seal member fitting groove 14, a second side engaging piece 81 to be engaged with the second side engaging portion 14*b* of the seal member fitting groove 14 and an abutting piece 82 to be faced to the second side oblique surface 14*d* of the seal member fitting groove 14**.

The second side seal member 70 is mounted in the manner shown in FIG. 4. The fitting portion 72 is fitted into the seal member fitting groove 14 in the manner that the first side and second side engaging pieces 80 and 81 are engaged with the first side and second side engaging portions **14*a* and 14*b*, respectively. The supporting portion 75 abuts against the connecting plate member 12. The main seal piece 76 of the sealing portion 71 is brought into pressure contact with the second side surface 7*b* of the glass 7, and the engaging piece 79 is engaged on the engaging portion 18** provided for preventing the seal member from coming off.

The structure for attaching the glass 7 to upper transverse frame member 1 has been described hereinbefore. The structure for attaching the glass 7 to the other frame members is substantially the same.

In the above mentioned structure, when a certain object is blown off by a strong wind to collide with and crack the glass 7, the glass 7 is not scattered in pieces but maintained in the cracked state owing to the scattering preventing film 9 applied on the surface of the glass 7. Since the rigidity of the glass 7 is reduced in this state, the glass 7 is curved and deformed by the wind pressure $F_1$ as shown with two-dots and dash lines in FIG. 4 with a portion supported by the first side seal member 60 as a fulcrum, and consequently, a force $F_2$ which urges the glass 7 to come off the glass attachment channel 13 acts on the glass 7. Owing to the force $F_2$, the fitting portion 72 of the second side shaped seal gasket 70 is also urged to come off the sealing member fitting groove 14. However, since the engaging piece 79 of the sealing portion 71 is engaged on the engaging portion 18, the seal member 70 is prevented from coming off the glass attachment channel 13 of the upper transverse frame member 1 and keeps functioning to prevent the glass 7 from coming off the sash frame.

Further, when the glass 7 is curved and deformed as mentioned above, a portion of the glass supported by the seal member 70 is inclined relative to the vertical so that the second side surface **7*b* of the glass 7 is brought into pressure contact with the first and second auxiliary seal pieces 77 and 78 as shown with two-dots and dash line in FIG. 4. The end portion of the main seal piece 76 is elastically restored to keep the pressure contact with the second side surface 7*b* of the glass 7. Thus, the area of the sealing portion 71 of the seal member 70 being in contact with the second side surface 7*b* of the glass 7 is increased and accordingly the friction force is increased, which means that the glass supporting force is increased. Therefore, the glass 7** is securely supported and prevented from coming off.

As mentioned above, according to the present invention, the glass 7 can be reliably prevented from coming off the sash frame owing to the combined effects that the seal member 70 is prevented from coming off the upper transverse frame member 1 and that the glass supporting force of the seal member 70 is increased.

In addition, since the second auxiliary seal piece 78 is, as described above, so formed as to have an inclination larger than that of the first auxiliary seal piece 77 relative to the plane perpendicular to the first side surface 74*a* of the body portion 74, the second auxiliary seal piece 78 is largely elastically deformed accompanying the curved deformation of the glass 7. The pressing force of the second auxiliary piece 78 to the second side surface 7*b* of the glass 7 becomes larger according to the magnitude of the curved deformation of the glass 7, which means that the glass supporting force becomes larger according to the magnitude of the curved deformation of the glass 7.

Further, the engaging piece 79 is more firmly engaged on the engaging portion 18 when the second auxiliary seal piece 78 is elastically deformed. Therefore, the force for retaining the seal member 70 to the upper transverse frame member 1 is also increased according to the magnitude of the curved deformation of the glass 7.

In the embodiment mentioned above, the first and second auxiliary seal pieces 77 and 78 are so provided that they are normally positioned separate from the second side surface 7*b* of the glass 7. However, such provision is also possible that these auxiliary seal pieces are normally in contact with the second side surface 7*b* of the glass 7 with a weak pressing force.

Other embodiments of the present invention will be described hereunder with reference to FIGS. 5 to 7.

Figure 5:
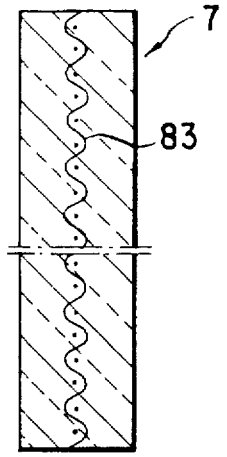
FIG. 5 is a sectional view of a kind of a glass to be used.
Figure 6:
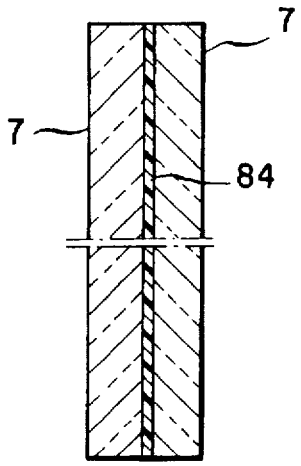
FIG. 6 is a sectional view of another kind of a glass to be used.

FIGS. 5 and 6 shows other structures of the glass for use in the glass attachment structure according to the present invention. In FIG. 5, a wire element 83 is embedded in the glass to thereby form a wired glass 7. In FIG. 6, two sheets of glasses 7 are bonded with film 84 such as a transparent plastic film interposed therebetween.

Figure 7:
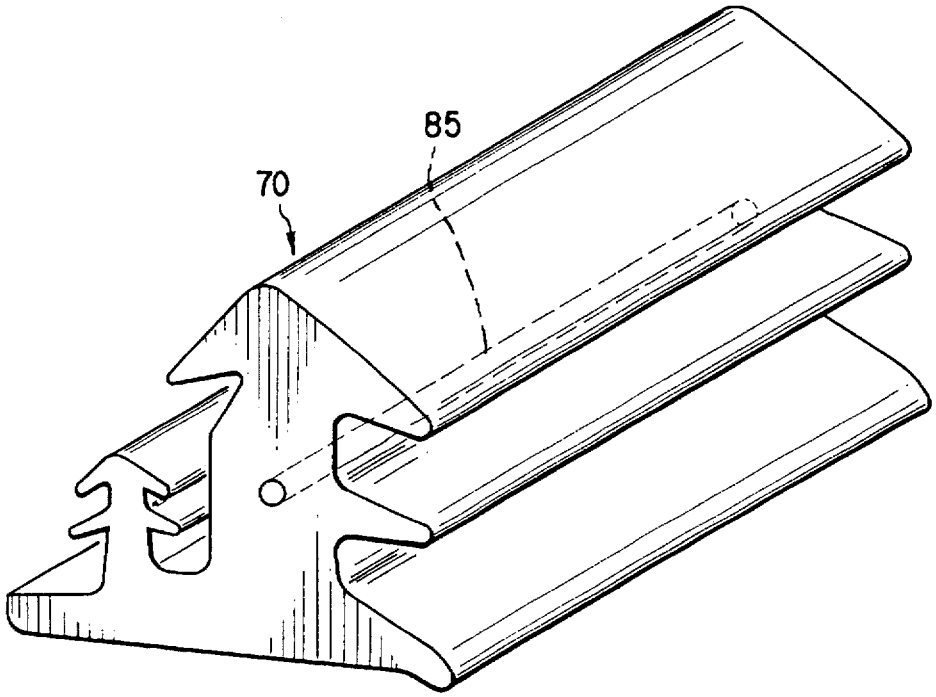
FIG. 7 is a perspective view of a kind of a shaped seal gasket provided with a reinforcing core member.

FIG. 7 shows another structure of a shaped seal gasket for use as the second side seal member 70 in the glass attachment structure according to the present invention. Here, a reinforcing core member 85 is embedded in the shaped seal gasket 70 continuously in the longitudinal direction thereof. For the reinforcing core member 85, a string or wire element such as sennit, braid or metal wire filament having low elasticity in the longitudinal direction and high flexibility is used.

In this structure, the elasticity in the longitudinal direction of the shaped seal gasket made of a rubber-like material is negated by the reinforcing core member 85, and the shaped seal gasket will not be stretched when it is fitted. Therefore, it will not be happen that the shaped seal gasket shrinks after the glass is fitted so that a gap is produced between the frame member and the glass.

Since the reinforcing member 85 has a flexibility, it will not cause difficulties when the shaped seal gasket is fitted.

Thus, in the shaped seal gasket according to this structure, it is not necessary to take care that the shaped seal gasket is not stretched at the time of fitting thereof. Therefore, the fitting of the shaped seal gasket can be easily carried out.

What is claimed is:

1. A sash frame structure, comprising:

a glass supported in glass attachment channels formed in respective frame members constituting a sash frame by first side seal members and second side seal members disposed on opposite sides of the glass, said glass being resistant to shattering; a seal member fitting groove formed in each of the frame members adjacent said glass attachment channel; an engaging portion being formed in an inner surface of said glass attachment channel on the side adjacent said seal member fitting groove, one of said first side seal member and second side seal member being a shaped seal gasket having a sealing portion and a fitting portion integrally formed together;

said sealing portion being disposed in a space between the glass and the inner surface of said glass attachment channel and engaged to said engaging portion while said fitting portion is fitted in said seal member fitting groove;

said sealing portion of the shaped seal gasket comprising a body portion integrally formed with a main seal piece, a first auxiliary seal piece and a second auxiliary seal piece, each respectively projecting toward the glass to be supported, said body portion being further provided with an integrally formed engaging piece which is engaged to said engaging portion formed on the inner surface of said glass attachment channel, said main seal piece having a projection length longer than that of said first and second auxiliary seal pieces and said main seal piece being brought in pressure contact with the glass with an end portion of said main seal piece elastically bent on the glass when the shaped seal gasket is fitted in place; and said main seal piece, said first auxiliary seal piece and said second auxiliary seal piece positioned at a distance from each other in a depth direction of said glass attachment channel, said main seal piece being positioned at a position nearest to an open end of said glass seal attachment channel, said second auxiliary seal piece being positioned at a position nearest to the bottom surface of the glass attachment channel and continuously connected to said engaging piece, and said first auxiliary seal piece being positioned between said main seal piece and said second auxiliary seal piece, and at least one of said first and second auxiliary seal pieces being positioned apart from the glass when said shaped seal gasket is fitted in place.

2. A sash frame structure according to claim 1, wherein said main and auxiliary seal pieces obliquely project with different predetermined inclinations with respect to a plane perpendicular to the side surface of the body portion from which said main and auxiliary seal pieces project, said first auxiliary seal piece has the smallest inclination, the second auxiliary seal piece has the largest inclination and the main seal piece has an intermediate inclination.

3. A sash frame structure according to claim 1, wherein said main seal piece has the largest thickness, the first auxiliary seal piece has the smallest thickness and the second auxiliary seal piece has an intermediate thickness.

4. A sash frame structure according to claim 1, wherein the other of said first side and second side seal members is liquid applied sealant.

5. A sash frame structure according to claim 1, wherein a reinforcing member having low elasticity in the longitudinal direction and high flexibility is embedded in said shaped seal gasket continuously in the longitudinal direction thereof.

6. A sash frame structure according to claim 1, wherein said glass is provided with a scattering preventing film applied on one side surface thereof.

7. A sash frame structure according to claim 1, wherein said glass is a wired glass having a wire element embedded.

8. A sash frame structure according to claim 1, wherein said glass is formed of two glass sheets bonded with a transparent film interposed therebetween.

9. A sash frame structure for attaching a glass, comprising:

a frame member having a glass attachment channel, a seal member fitting groove adjacent the glass attachment channel and an engaging portion at an inner surface of the glass attachment channel on the side adjacent the seal member fitting groove;

a first side seal member and a second side seal member adapted for being disposed on opposite sides of the glass attachment channel, at least one of the first side seal member and second side seal member being a shaped seal gasket having a seal portion and a fitting portion integrally formed thereon, said sealing portion being adapted for being fitted in a space between the glass and the inner surface of the glass attachment channel and engaged to the engaging portion while the fitting portion is fitted in the seal member fitting groove;

the sealing portion of the shaped seal gasket comprising a body portion provided with an integrally formed engaging piece which is engaged to said engaging portion formed on the inner surface of the glass attachment channel, the main seal piece being adapted for being elastically bent on the glass when the shaped gasket is fitted in place, the body portion of the seal portion being integrally formed with at least one said main seal piece and at least one auxiliary seal piece with a space between each other in a depth direction of the glass attachment channel, at least one auxiliary seal piece being positioned apart from the glass when said shaped seal gasket is fitted in place.

10. A sash frame structure for attaching a glass according to claim 9, wherein said body portion is integrally formed with one said main seal piece, a first said auxiliary seal piece and a second said auxiliary seal piece, said main seal piece being positioned at a position nearest to an open end of said glass seal attachment channel, said second auxiliary seal piece being positioned at a position nearest to the bottom surface of the glass attachment channel and continuously connected to said engaging piece, and said first auxiliary seal piece being positioned between said main seal piece and said second auxiliary seal piece.

11. A sash frame structure for attaching a glass according to claim 10, wherein the main and auxiliary seal pieces obliquely project with different predetermined inclinations with respect to a plane perpendicular to the side surface of the body portion from which the main auxiliary seal pieces project, the first auxiliary seal piece has the smallest inclination and the main seal piece has an intermediate inclination.

12. A sash frame structure for attaching a glass according to claim 10, wherein the main seal piece has the largest thickness, the first auxiliary seal piece has the smallest thickness and the second auxiliary seal piece has an intermediate thickness.

13. A sash frame structure for attaching a glass according to claim 10, wherein the other of the first side and second side seal members is liquid sealant.

14. A sash frame structure for attaching a glass according to claim 10, wherein a reinforcing member having low elasticity in the longitudinal direction and high flexibility is embedded in the shaped seal gasket continuously in the longitudinal direction thereof.

* * * * *